US007938508B2

(12) United States Patent
Anderson et al.

(10) Patent No.: US 7,938,508 B2
(45) Date of Patent: May 10, 2011

(54) LOW PROFILE PRINTHEAD

(75) Inventors: Frank E. Anderson, Sadieville, KY (US); Curtis R. Droege, Richmond, KY (US); Sam Norasak, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 216 days.

(21) Appl. No.: 12/336,117

(22) Filed: Dec. 16, 2008

(65) Prior Publication Data

US 2009/0153616 A1 Jun. 18, 2009

Related U.S. Application Data

(62) Division of application No. 11/096,585, filed on Apr. 1, 2005, now abandoned.

(51) Int. Cl.

| | |
|---|---|
| ***B41J 2/14*** | (2006.01) |
| ***B41J 2/16*** | (2006.01) |
| ***B41J 2/05*** | (2006.01) |
| ***B41J 2/15*** | (2006.01) |
| ***B41J 2/145*** | (2006.01) |

(52) U.S. Cl. ..... 347/50; 347/40; 347/58

(58) Field of Classification Search ..... 347/50, 347/58, 59, 9, 108, 86, 40, 49

See application file for complete search history.

(56) References Cited

U.S. PATENT DOCUMENTS

| | | | | |
|---|---|---|---|---|
| 5,016,023 | A * | 5/1991 | Chan et al. | 347/42 |
| 5,600,354 | A * | 2/1997 | Hackleman et al. | 347/50 |
| 5,847,734 | A * | 12/1998 | Pawlowski, Jr. | 347/86 |
| 5,969,729 | A * | 10/1999 | Erickson et al. | 347/9 |
| 6,068,367 | A * | 5/2000 | Fabbri | 347/49 |
| 6,394,580 | B1 * | 5/2002 | Scheffelin et al. | 347/50 |
| 6,450,617 | B1 * | 9/2002 | Kitani et al. | 347/50 |
| 6,471,335 | B1 * | 10/2002 | Gelbart | 347/49 |
| 6,543,887 | B2 * | 4/2003 | Chang et al. | 347/87 |
| 6,755,513 | B1 * | 6/2004 | Silverbrook et al. | 347/85 |
| 6,789,871 | B2 * | 9/2004 | Edelen et al. | 347/19 |
| 2003/0128254 | A1 * | 7/2003 | Ison et al. | 347/49 |
| 2003/0184618 | A1 * | 10/2003 | Childers et al. | 347/59 |

FOREIGN PATENT DOCUMENTS

| | | | |
|---|---|---|---|
| EP | 581297 | A2 * | 2/1994 |
| JP | 05004339 | A * | 1/1993 |

* cited by examiner

*Primary Examiner* — Stephen D Meier
*Assistant Examiner* — Leonard S Liang

(57) ABSTRACT

An inkjet printhead having a housing having a top face and a bottom face, an ink ejection device and a contact circuit. The contact circuit is affixed to the housing in a substantially horizontal orientation and is in communication with the ink ejection device. The contact circuit is configured to connect the ink ejection device to an external device.

1 Claim, 5 Drawing Sheets

LOW PROFILE PRINTHEAD

CROSS REFERENCE TO RELATED APPLICATION

Pursuant to 37 C.F.R. §1.78, this application is a divisional and claims the benefit of the earlier filing date of application Ser. No. 11/096,585 filed Apr. 1, 2005 now abandoned entitled "Low Profile Printhead."

BACKGROUND OF THE INVENTION

The present invention generally relates to inkjet printheads. More particularly, the present invention relates to low-profile inkjet printheads having a contact circuit disposed in a substantially horizontal orientation, such as on a top face of the printhead.

Inkjet printing is a conventional technique by which printing is normally accomplished without contact between the printing apparatus and the substrate, or medium, on which the desired print characters are deposited. Conventional inkjet printing devices such as a fax, printer, photo-printer, all-in-one device, plotter, or any other device incorporating inkjet printing technology typically include one or more printheads in which ink is stored. Such printheads generally are placed within a movable print carriage of the inkjet device. An image is produced by emitting ink drops from an inkjet printhead at precise moments such that they impact a print medium at a desired location. A microprocessor or other controller causes the carriage to reciprocate relative to an advancing print medium and the printhead to emit ink drops at such times corresponding to a pattern of pixels of the image being printed. Such printing is accomplished by ejecting ink from the inkjet printhead of the printing device via numerous methods which employ, for example, pressurized nozzles, electrostatic fields, piezo-electric elements and/or heaters for vapor phase bubble formation.

By way of example, in a thermal inkjet printhead, the ink drops are ejected from individual nozzles by localized heating. The thermal inkjet printhead includes access to a local or remote supply of color or mono ink, a heater chip, a nozzle or orifice plate attached to the heater chip, and a contact circuit in electrical communication with the heater chip. This contact circuit is configured to electrically connect the heater chip to the external device (i.e. a printer) during use. It generally includes input/output connectors (i.e., contacts) that mate with corresponding input/output connectors located on the printer carriage to form an electrical connection between the heater chip and printer. In general, the contact circuit and heater chip comprise a tape automated bond ("TAB") circuit that is attached to the printhead such that the contact circuit is bonded to a side wall of the printhead such that input/output connectors of the printhead are in a vertical orientation and the heater chip is bonded to a portion of a bottom face of the printhead.

To install these printheads, a user generally must push the printhead into the carriage and then either snap the printhead upward or downward into its locked position within the carriage. When the printhead is properly installed, its vertical input/output connectors mate and form an electrical connection with the vertical input/output connectors of the printer carriage. However, due to the multiple direction movement required to connect conventional printheads to a carriage, users are many times unable to completely and properly form the necessary vertical pressure contact connection, thus causing improper printing. It is desirable to have an improved pressure contact electrical connection.

Due to the area required for the contact circuit (in order to provide sufficient electrical contact) and the placement of the contact circuit on the printhead's vertical side face, conventional printheads have had relatively large height profiles. This height profile has limited manufacturers' ability to decrease the height of printers (i.e. minimum printer height was constrained by height of printhead). In addition, this additional height (i.e., additional materials) of the printhead and printer increases the costs to make the printheads and printers due to the additional materials. Also, the additional height increases the weight of the printhead and printer, thus increasing the packaging and shipping costs.

The printheads have a high center of gravity, which requires printer manufacturers to place limits on the speed of the printer carriage and the number of printheads that can be placed in the carriage in order to prevent printer instability at higher carriage speeds. Limiting the number of printheads has prevented manufacturers from providing more printhead and color combination options. Accordingly, there is a need for improved inkjet printheads.

SUMMARY OF THE INVENTION

Accordingly, the present invention is intended to address and obviate problems and shortcomings and otherwise improve previous inkjet printheads.

One exemplary embodiment of the present invention is an inkjet printhead. The inkjet printhead comprises a housing and an ink ejection device attached to the housing. A contact circuit is attached to the housing in a substantially horizontal orientation and is in communication with the ink ejection device. The contact circuit is configured to connect the ink ejection device to an external device.

Another exemplary embodiment of the present invention is a low-profile inkjet printhead. The low-profile inkjet printhead comprises a housing having a top face, at least one side face and a bottom face. A tape automated bond circuit is attached to the housing. The tape automated bond circuit comprises a substantially horizontal contact circuit, an ink ejection device and a plurality of traces connecting the contact circuit to the ink ejection device. An ink nozzle assembly is affixed to the ink ejection device and an ink reservoir is disposed within the housing. The ink reservoir is in fluid communication with the nozzle assembly.

Yet another exemplary embodiment of the present invention is an inkjet printhead. The inkjet printhead comprises a housing and a tape automated bond circuit. The tape automated bond circuit has a contact circuit and an ink ejection device in communication with the contact circuit. The inkjet printhead defines a vertical height of less than about 20 mm.

BRIEF DESCRIPTION OF THE DRAWINGS

While the specification concludes with claims particularly pointing out and distinctly claiming the invention, it is believed the same will be better understood from the following description taken in conjunction with the accompanying drawings in which:

Figure 1:
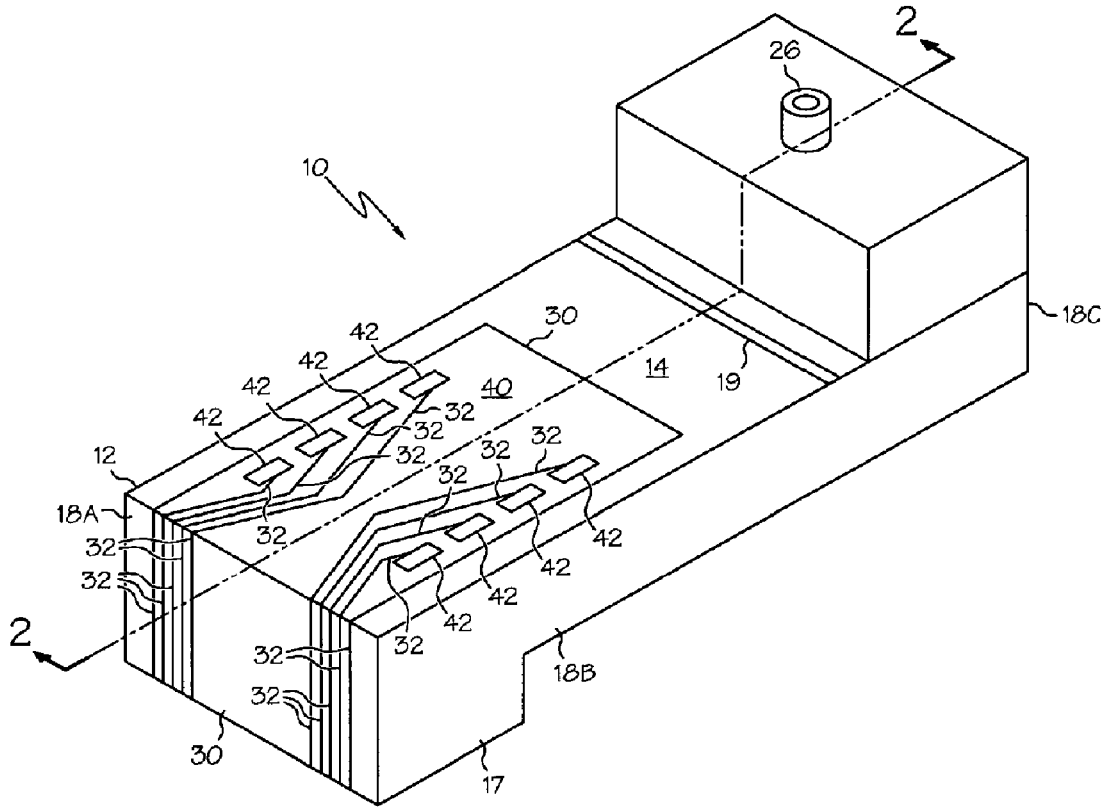
FIG. 1 is a perspective view of an exemplary embodiment of the inkjet printhead according to the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF THE EXEMPLARY EMBODIMENTS

Reference will now be made in detail to various embodiments of the invention, examples of which are illustrated in the accompanying drawings, wherein like numerals indicate similar elements throughout the views.

Figure 2:
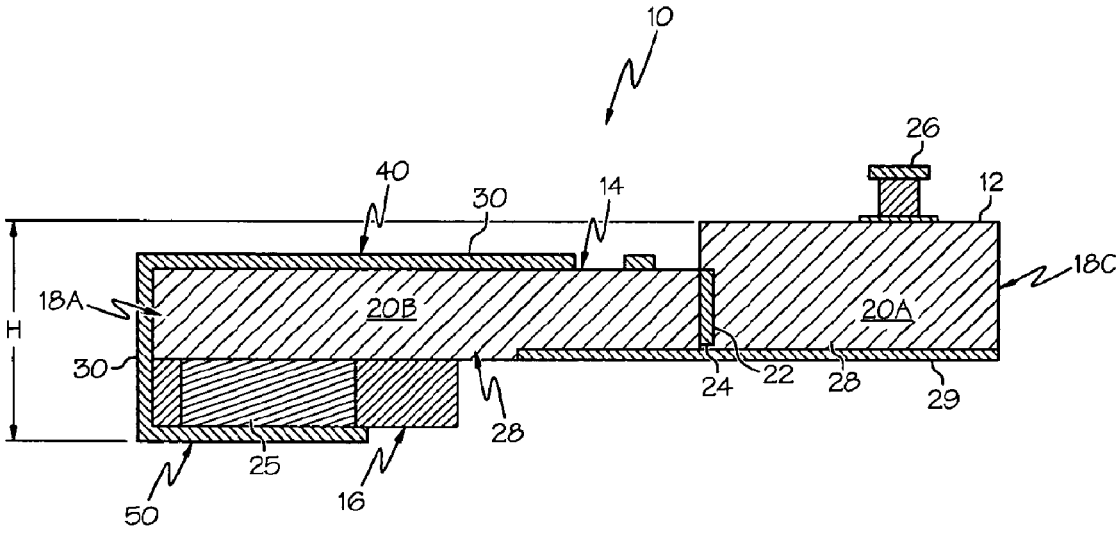
FIG. 2 is a cross sectional view taken along line A-A of the inkjet printhead illustrated in FIG. 1.
Figure 3:
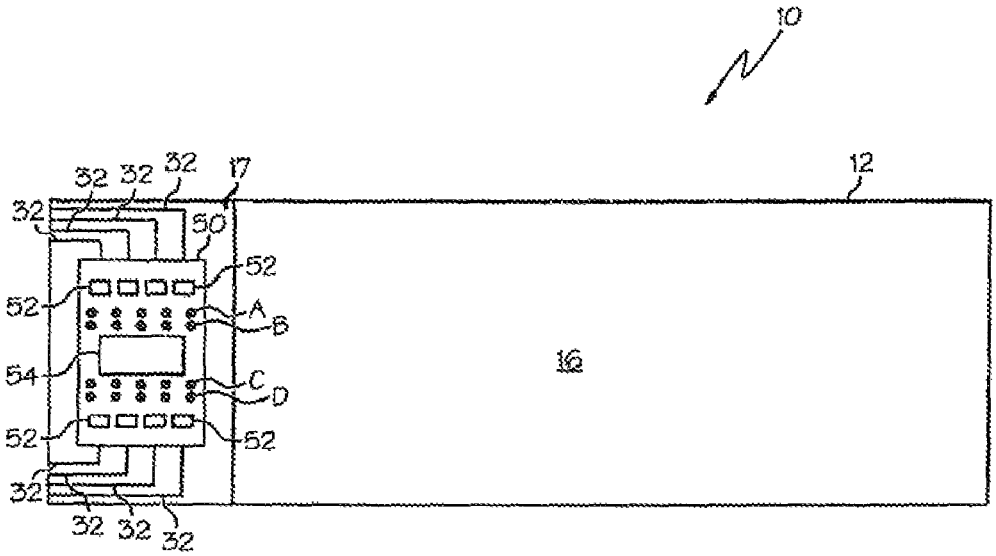
FIG. 3 is a bottom plan view of the inkjet printhead shown in FIG. 1.

An improved inkjet printhead, more particularly a low-profile inkjet printhead having a contact circuit disposed in a substantially horizontal orientation is disclosed. Referring to FIGS. 1-3, an exemplary embodiment of an inkjet printhead 10 of the present invention is shown as generally including a housing 12, a TAB circuit 30 containing a contact, circuit 40, and a heater chip 50 in communication with contact circuit 40. Housing 12 may be constructed of a variety of materials and combinations of materials including, without limitation, polymers, metals, ceramics, composites, and the like. Its shape and size may vary and often depends upon the external device that carries or contains the printhead. In the exemplary embodiment shown, housing 12 includes a top face 14, a bottom face 16, four vertical side faces 18*a*, 18*b*, 18*c*, and 18*d* and a snout 17 positioned at one end along bottom face 16. Although housing 12 is shown to include a snout 17 in this exemplary embodiment, it is understood that other embodiments of the present invention may not include a snout.

In addition, housing 12 may contain an ink reservoir for holding an initial or refillable supply of ink for controlled dispense upon a printing medium. As used herein and in the appended claims, the term "ink" may refer to at least one of inks, dyes, stains, pigments, colorants, tints, a combination thereof, and any other material known to one of ordinary skill in the art that can be used by an inkjet printing apparatus to print matter upon a print medium. As used herein and in the appended claims, the term "print medium" may refer to at least one of paper (including without limitation stock paper, stationary, tissue paper, homemade paper, and the like), film, tape, photo paper, a combination thereof, and any other medium upon which material can be printed by an inkjet printing apparatus.

The reservoir may include a single chamber that holds a supply of ink or multiple chambers that hold either a single or multiple colors of ink (e.g., three separate supplies of cyan, magenta and yellow ink). In addition, printhead 10 may include a receptacle (not shown) configured to receive a replaceable ink cartridge that fluidly connects to the ink reservoir to supply ink to this reservoir.

As shown in FIG. 2, the reservoir, in this exemplary embodiment, includes a first ink chamber 20*a* and a second ink chamber 20*b* for holding a single color of ink. A wall 22 may separate first chamber 20*a* from second chamber 20*b* with only a passage 24 fluidly connecting the two chambers. First and second chambers 20*a* and 20*b* may define a substantially empty chamber for holding ink. Alternatively, first and second chambers 20*a* and 20*b* may house an ink retaining medium 28 suitable for holding ink within the reservoir. Ink retaining medium 28 may occupy any portion and amount of the reservoir desired. For example, ink retaining medium 28 is located within first ink chamber 20*a* and second ink chamber 20*b* as illustrated in FIG. 2, and substantially occupies the entire interior of the chambers. Ink retaining medium 28 may include any material or combinations of materials known to one of ordinary skill in the art capable of retaining fluid by capillary action, including without limitation artificial or natural sponge, foam, felt, and the like.

In another exemplary embodiment, the ink retaining medium 28 is located to be in fluid communication with one or more elements supplying ink to the ink retaining medium and/or one or more elements drawing ink from ink retaining medium 28. In addition, printhead 10 may include a wick 29 that controls the flow of ink from first chamber 20*a* to second chamber 20*b* through passage 24. Wick 29 may include any material or combinations of materials known to one of ordinary skill in the art capable of retaining fluid by capillary action, including without limitation artificial or natural sponge, foam, felt, and the like. Such a wick 29 is shown and described in commonly assigned, co-pending U.S. patent application Ser. No. 11/018,025 titled "Bridging Wick and Method For An Inkjet Printhead and herein incorporated by reference.

Printhead 10 may also include a filter tower 25 fluidly connected to chamber 20*b* and positioned just below such chamber. Any conventional filter tower may be used in conjunction with the present invention without departing from the spirit and scope of the present invention. Such filter tower may assist in the controlled dispense of the ink from the reservoir.

In addition, housing 12 may include a refill port 26 fluidly connected to the reservoir (e.g., first chamber 20*a*). Such refill port may be configured to fluidly connect the reservoir to a local or remote ink tank (not shown) to allow the reservoir to be refilled with ink. In one exemplary embodiment, refill port 26 may be fluidly connected to a feed tube that is connected to the remote tank to provide a constant supply of ink to printhead 10. In still another embodiment, printhead 10 is moved under a refill tank such that refill port 26 connects with a mating port (not shown) located on the refill tank (not shown) to provide refill supply of ink.

Still referring to FIGS. 1-3, printhead 10 is shown having a TAB circuit 30 affixed (e.g., pressure-sensitive adhesive, epoxy, etc.) or any other conventional means of attachment to housing 12. TAB circuit 30 may be any type of conventional or yet-to-be developed TAB circuit. For example, TAB circuit 30 may be made from flexible web material (e.g., a polymer substrate) with pressure-sensitive adhesive coating on its back surface. TAB circuit 30 also includes a contact circuit 40 and a heater chip 50 connected to contact circuit 40. In this embodiment, TAB circuit 30 is affixed (e.g. bonded) to housing 12 such that it overlaps from top face 14 along side face 18*a* to bottom face 16. In this configuration of TAB circuit 30, contact circuit 40 is disposed along top face 14 in a substantially horizontal orientation and heater chip 50 is disposed along snout 17 of bottom face 16.

in another exemplary embodiment of the present invention, contact circuit 40 may include a plurality of substantially horizontal input/output connectors 42 for electrically connecting heater chip 50 to an external device (e.g., a printer, fax machine, etc.) during use. Contact circuit, as used herein, defines a circuit that includes one or more flat-surface connectors or contacts that form an electrical connection when pressed and held together (i.e., in pressure contact) with corresponding flat-surface connectors. In the exemplary embodiment shown in FIGS. 1-3, input/output connectors 42 mate with corresponding, substantially horizontal input/output connectors located on the external device.

When a user installs the printhead, due to the horizontal orientation of the contact circuit, the user only needs to per-form a single-direction movement to lock the printhead in place on a carriage of the external device. Such a single-direction locking movement provides a simpler and more consistent electrical connection during installation. In addition, the horizontal pressure contact circuit (i.e., 40)-to-contact circuit (of external device 60) connection provides for an improved electrical connection during operation of the external device and thus improved printing. However, due to the single-direction movement, an user may have a tendency to exert to much force to lock the printhead into the carnage of the external device, thus causing damage to contact circuit 40. To protect the circuit from this excessive force, housing 12 may include a contact circuit guard 19 affixed to top face 14 of housing 12. Such a guard may comprise a resilient material with sufficient rigidity to prevent the user from pressing together contact circuit 40 and its mating circuit on the external device together to such an extent that either one or both are damaged.

Electrical traces 32 exist on TAB circuit 30 to electrically connect and short input/output connectors 42 to input terminals (i.e., bond pads 52, discussed later) of heater chip 50. For illustration purposes only, and not limitation, only eight input/output connectors 42, eight electrical traces 32, and eight bond pads 52 have been shown. However, it is understood that any number of connectors, traces, and bond pads, including unequal numbers, may be used without departing from the scope of the present invention. In addition, connectors 42 and bond pads 52 may be configured in any number of arrangements known to one of ordinary skill in the art such as staggered array groups, linear arrangements, stair-step profiles, or other relative relationships.

Printhead 10 may include one or more heater chips affixed to any portion of housing 12. As shown in FIGS. 2-3, heater chip 50 is disposed on snout 17 of housing 12. Heater chip 50 may contain an ink via 54 that is in fluid communication with the ink supply contained in the reservoir (e.g., first and second chambers 20*a* and 20*b*). Although, any number of ink vias 54 may be used with the present invention. Each via is formed, by any of the processes known to one of ordinary skill in the art, including, but not limited to, grit blasting, deep reactive ion etching, ion etching, wet etching, laser cutting, or plunge cutting, in a substrate of heater chip 50. In another exemplary embodiment, heater chip 50 contains at least three ink vias in fluid communication to a cyan, yellow, magenta, and/or black ink supply in the reservoir.

As mentioned above, heater chip 50 may include any number of input terminals, (i.e., bond pads 52) that electrically connect input/output connectors 42 of contact circuit 40 to resistive heater elements or thin film resistors (hereinafter, "heaters"). Heater chip 50 may contain any number of rows of these heaters. As shown in FIG. 3, heater chip 50 includes four rows. Rows A, B, C and D, of heaters arranged with two rows of heaters per longitudinal side of ink via 54. Rows A and D are far rows of heaters while Rows B and C are near rows of heaters. Such rows of near and far heaters are a reference to a distance of the rows to ink via 54. As implied by their names, the row of near heaters is closer in distance to the ink via than the row of far heaters. For simplicity in this crowded figure, the pluralities of heaters in rows A through D are shown as dots. It will be appreciated, however, that the rows of heaters may include any number of heaters and be further defined in staggered array groups, linear arrangements, stair-step profiles, or other relative relationships. In one exemplary embodiment, each row contains about 160 heaters. Such heater elements may be fabricated by any technique known to one of ordinary skill in the art including, but not limited to, deposition, masking, and etching techniques on a substrate such as silicon.

In still another exemplary embodiment, contact circuit 40 and heater chip 50 may be separate devices separately affixed to housing 12 but not part of a TAB circuit. However, both would still be in electrical communication with one another via some type of electrical connection (e.g., wires or traces). In this alternative exemplary embodiment, contact circuit 40 may be affixed to housing 12 in a substantially horizontal orientation (e.g., bonded to top face 14 of housing 12).

Referring to FIG. 2, printhead 10 has an improved height 'H', i.e., low-profile. Due to the positioning of contact circuit 40 on a horizontal face on housing 12 (e.g., top face 14), the height 'H' of printhead 10 may be at least 30% less than conventional printhead heights, and in many cases at least 50% less than conventional printhead heights. Printhead 10 may have a height 'H' of 20 mm or less. In one embodiment, the printhead's height 'H' is 15 mm. In an alternative embodiment, the printhead height is from about 15 mm to about 20 mm.

A nozzle assembly (not shown) such as a nozzle or orifice plate may be affixed to heater chip 50. Such a nozzle assembly may include orifices thereof aligned with each of the heaters to project the ink during use. The nozzle plate may be attached with an adhesive or epoxy or may be fabricated as a thin-film layer. It will be understood by one of ordinary skill in the art, that any known or yet-to-be discovered heater chip and nozzle assembly may be used without departing from the scope of the present invention. A few exemplary heater chips and nozzle assemblies that may be used with the present invention are shown and described in the following commonly assigned patents: U.S. Pat. No. 6,789,871 to Edelen et al.; U.S. Pat. No. 6,834,941 to Bell et al.; U.S. Pat. No. 6,773,869 to Patil; and U.S. Pat. No. 6,709,805 to Patil, all of which are herein incorporated by reference.

Figure 4:
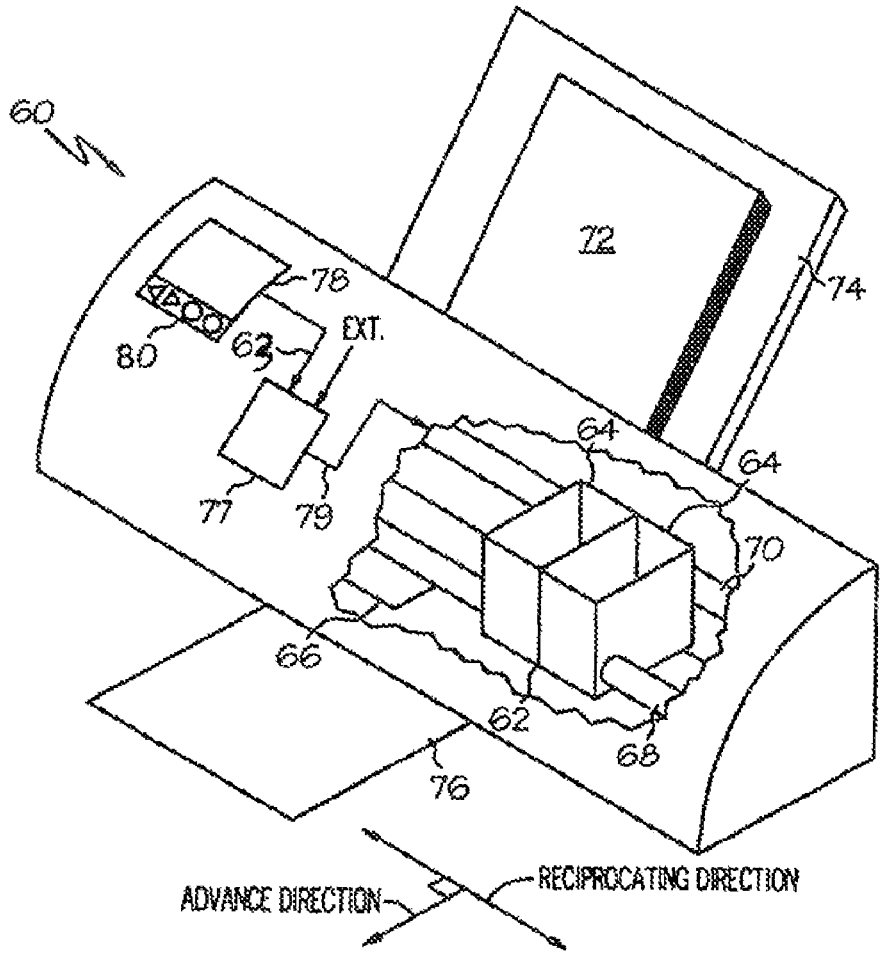
FIG. 4 is a perspective view of an exemplary embodiment of an inkjet printer that may be used with the inkjet printhead illustrated in FIG. 1.

With reference to FIG. 4, an external device in the form of an inkjet printer for containing the printhead 10 is shown generally as 60. The printer 60 includes a carriage 62 having one or more positions 64 for containing one or more printheads 10. The carriage 62 reciprocates (in accordance with an output 79 of a controller 77) along a shaft 68 above a print zone 66 by a motive force supplied to a drive belt 70 as is well known in the art. The reciprocation of the carriage 62 occurs relative to a print medium, such as a sheet of paper 72 that advances in the printer 60 along a paper path from an input tray 74, through the print zone 66, to an output tray 76. As one skilled in the art will appreciate, any carriage movement mechanism may be utilized which provides the necessary precision in the carriage movement.

While in the print zone, the carriage 62 reciprocates in the Reciprocating Direction generally perpendicular to the paper 72 being advanced in the Advance Direction as shown by the arrows. Ink drops from the reservoir (i.e., second chamber 20*b*, FIG. 2) are caused to be ejected from the heater chip 50 at such times pursuant to commands of a printer microprocessor or other controller 77. The timing of the ink drop emissions corresponds to a pattern of pixels of the image being printed. Often times, such patterns become generated in devices electrically connected to the controller 77 (via external input) that reside externally to the printer and include, but are not limited to, a computer, a scanner, a camera, a visual display unit, a personal data assistant, or other.

To print or emit a single drop of ink, the heaters (i.e., the dots of rows A-D, FIG. 3) are uniquely addressed with a small amount of current to rapidly heat a small volume of ink. This causes the ink to vaporize, which may be located in a local ink chamber between the heater and the nozzle plate and eject through, and become projected by, the nozzle plate towards the print medium. The fire pulse required to emit such an ink drop may embody a single or a split firing pulse. A control panel 78 having user selection interface 80 also accompanies many printers, as an input 63 to controller 77, to provide additional printer capabilities and robustness.

Figure 5:
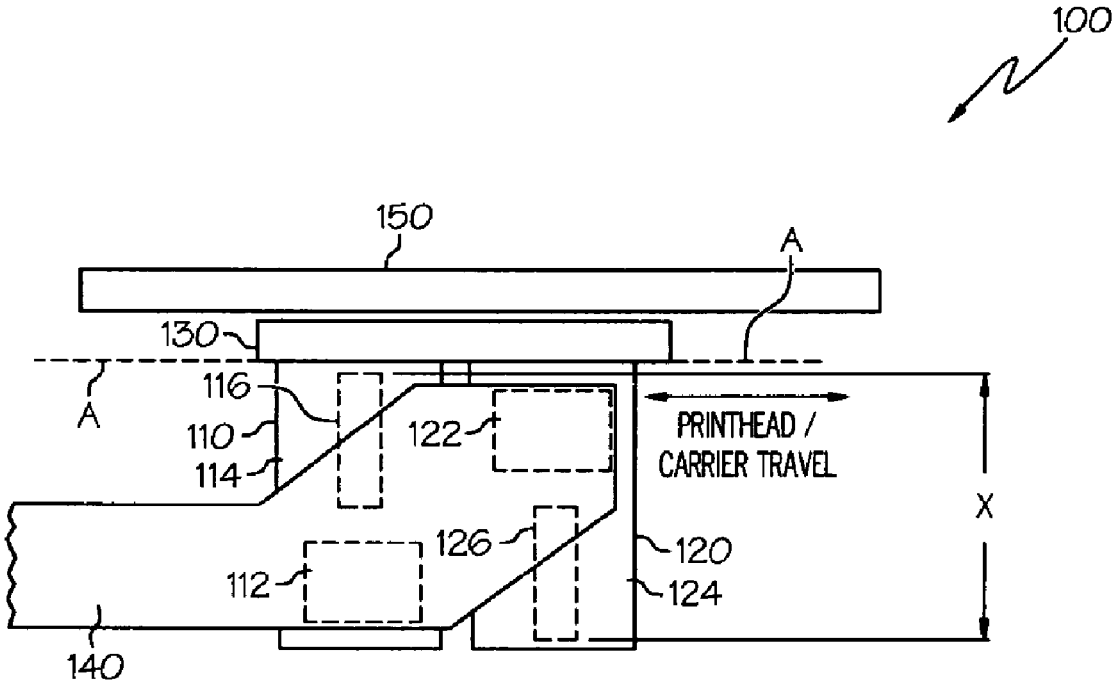
FIG. 5 is a top view of an inkjet printing device according to an exemplary embodiment of the present invention.

Another advantage of having the contact circuit mounted on a substantially horizontal top face of the printhead is that two printheads may be mounted to a carrier housing such that the print swath (i.e., the print width capable in one sweep of the carrier housing) is increased without interfering with the carrier guide rod of the printer or requiring a complex carrier housing and flex cable configuration. Conventionally, in order to increase the print swath, the carrier housing has been modified to offset both the printhead and the heater chip, creating an expensive and complex carrier housing and flex cable configuration. In addition, since the printheads are not aligned, the printhead volume that must be moved during the sweep of the carrier housing is increased. The exemplary embodiment shown in FIG. 5 provides an improved printhead and carrier housing configuration that includes an increased print swath. A schematic of a printer 100 includes a carrier housing 130 having two printheads 110 and 120. Printheads 110 and 120 include respective contact circuits 112 and 122 mounted on a top face 114 and 124 of printheads 110 and 120. These contact circuits make an electrical connection with a flex cable 140 that is disposed above printheads 110 and 120. As shown, printheads 110 and 120 are mounted on one side of carrier housing 130 in opposite orientations such that each respective heater chip 116 and 126 are offset 180 degrees from each other. In other words, printhead 110 is mounted on carrier housing 130 such that heater chip 116 is positioned at the end of printhead 110 closest to carrier housing 130, while printhead 120 is mounted on carrier housing 130 such that heater chip 126 is positioned at the end of printhead 120 furthest from carrier housing 130. In this exemplary embodiment, both printheads attach to carrier housing 130 along the same vertical plane such that both printheads are aligned with each other, only heater chips 116 and 126 are offset from one another. This configuration provides an enlarged print swath (X) in a relatively inexpensive and uncomplicated printhead-to-carrier housing/flex cable configuration that does not interfere with a carrier guide rod 150. Because the printheads are aligned with one another, the printhead volume that is moved during a sweep of carrier housing is less compared to conventional enlarged print swath configuration. In this exemplary embodiment the print swath (X) is twice as large as a print swath of a single printhead.

The foregoing description of the various embodiments of the invention has been presented for the purposes of illustration and description. It is not intended to be exhaustive or to limit the invention to the precise form disclosed. Many alternatives, modifications and variations will be apparent to those skilled in the an of the above teaching. For example, the printhead in accordance with the present invention may include a contact circuit 40 affixed to bottom face 16 of housing 12 in a substantially horizontal orientation. While the exemplary embodiments illustrated herein incorporate thermal inkjet printhead technology, as will be apparent to those of ordinary skill in the art the present invention may be employed in inkjet printheads which employ other technologies such as pressurized nozzles, electrostatic fields and/or piezo-electric elements. Accordingly, while some of the alternative embodiments of printheads have been discussed specifically, other embodiments will be apparent or relatively easily developed by those of ordinary skill in the art. Accordingly, this invention is intended to embrace all alternatives, modifications and variations that have been discussed herein, and others that fall within the spirit and broad scope of the claims.

What is claimed is:

1. An inkjet printing device, comprising:

a carrier housing movably connected to the printing device;

a first printhead mounted to one side of carrier housing, said first printhead having a contact circuit mounted on a top face of said first printhead and an ink ejection device mounted to a bottom face of said first printhead;

a second printhead mounted to said side of carrier housing adjacent to and aligned with said first printhead along a vertical plane, said second printhead having a contact circuit mounted on a top face of said second printhead and an ink ejection device mounted to a bottom face of said second printhead;

wherein said first and second printheads are configured such that said ink ejection device of said first printhead is offset from said ink ejection device of said second printhead and said ink ejection device of said second printhead is offset about 180 degrees from said ink ejection device of said first printhead.

* * * * *